US007659817B2

(12) United States Patent
Conti et al.

(10) Patent No.: US 7,659,817 B2
(45) Date of Patent: Feb. 9, 2010

(54) SECURITY DEVICE WITH PERIMETER ALARM

(75) Inventors: Brian V. Conti, Matthews, NC (US); Ningsheng Zhang, Charlotte, NC (US); Dennis D. Belden, Jr., Canton, OH (US); Lee H. Eckert, Waxhaw, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 11 days.

(21) Appl. No.: 12/176,526

(22) Filed: Jul. 21, 2008

(65) Prior Publication Data

US 2008/0316028 A1 Dec. 25, 2008

Related U.S. Application Data

(63) Continuation-in-part of application No. 11/289,246, filed on Nov. 29, 2005, now Pat. No. 7,403,118.

(51) Int. Cl.
*G08B 13/12* (2006.01)

(52) U.S. Cl. ..... 340/568.2; 340/652; 340/542; 340/571; 70/57; 70/57.1

(58) Field of Classification Search ..... 340/568.2, 340/652, 541, 542, 571, 572.1, 572.9; 70/57, 70/57.1

See application file for complete search history.

(56) References Cited

U.S. PATENT DOCUMENTS

| | | | | |
|---|---|---|---|---|
| 3,772,674 | A | 11/1973 | Jackson | |
| 5,610,587 | A | 3/1997 | Fujiuchi et al. | |
| 5,722,266 | A | 3/1998 | Yeager et al. | |
| 5,856,782 | A | 1/1999 | Sasagawa et al. | |
| 6,069,563 | A | 5/2000 | Kadner et al. | |
| 7,162,899 | B2 | 1/2007 | Fawcett et al. | |
| 2005/0253686 | A1 | 11/2005 | Shafer et al. | |
| 2007/0146134 | A1 * | 6/2007 | Belden et al. | 340/571 |
| 2008/0236209 | A1 * | 10/2008 | Conti et al. | 70/18 |

* cited by examiner

*Primary Examiner*—Daniel Wu
*Assistant Examiner*—Hongmin Fan
(74) *Attorney, Agent, or Firm*—Sand & Sebolt

(57) ABSTRACT

A security device for attachment to an article to deter theft has a housing containing an alarm system including an audible alarm speaker. The alarm system includes a conductor located within the housing which forms a loop that extends at least partially about the alarm speaker or about the periphery of the housing. The conductor which can be an electrical conductor, fiber optic conductor, light pipe, etc., when severed by a thief will actuate the audible alarm. In another embodiment, the conductor forms a loop about a simulated speaker grille formed in the housing to prevent tampering, wherein the audible alarm is located in the housing remote from the simulated speaker grille.

19 Claims, 12 Drawing Sheets

SECURITY DEVICE WITH PERIMETER ALARM

CROSS REFERENCE TO RELATED APPLICATION

This application is a continuation-in-part of U.S. patent application Ser. No. 11/289,246, filed Nov. 29, 2005; the disclosure of which is incorporated herein by reference.

BACKGROUND OF THE INVENTION

1. Technical Field

The invention relates to theft deterrent devices, and particularly to a device which wraps around, through or attached to a protected article with a security cable. Even more particularly, the invention relates to such a security device which includes an internal alarm system which is actuated if the cable is cut, and which includes an alarm conductor which extends about the perimeter of the security device or around the speaker of an audible alarm or about a simulated speaker grille formed on the housing which will actuate the audible alarm if an attempt is made to cut through the device or the audible alarm speaker or simulated speaker grille.

2. Background Information

Various retail establishments use numerous types of theft deterrent systems and devices to discourage shoplifting. Many of these devices attach to the article to be protected by cables which wrap around the device or extend through portions of the device or are secured thereto in other manners. The device will sound an alarm if the security device itself is tampered with, such as cutting the attachment cable. Also, the security devices will carry an EAS tag which will actuate an alarm of a security gate that is usually located at the exit of the retail establishment.

These security devices contain an alarm system which includes an audible alarm which emits a high pitched alarm sound through a speaker, such as a piezoelectric speaker, mounted in the security device. The alarm alerts store personnel that the article being protected thereby is being tampered with, as well as possible tampering of the security device itself. It has been found that some shoplifters having certain knowledge of the particular security device used thereon will deactivate the audible alarm speaker or portions of the security device by use of snips or other tools which will cut through the housing of the security device, which is usually formed of a rigid plastic. The snips will deactivate the speaker or other portions of the security alarm so that when the article is removed from the store or from the protected article, the alarm will not be sounded. Even though the housings of the security devices are rigid plastic, the snips which are usually used for metal working can cut through the housing to disarm the speaker and/or circuitry of the security device.

Thus the need exists for a security device, which in addition to providing the desired alarm system to a protected article, also incorporates a protection to prevent a shoplifter from disabling the alarm speaker and/or alarm circuitry by cutting through the housing of the security device with snips or other cutting mechanisms.

BRIEF SUMMARY OF THE INVENTION

One aspect of the present invention is to provide an alarm security device which is easily placed about an item of merchandise to be protected thereby by one or more cables, and which is easily removed from the protected device at a check-out station, and which may contain an EAS tag enabling the device to be reusable numerous times on various items of merchandise.

Another aspect of the invention is that the security device includes a housing usually formed of a rigid plastic material, which is protected by an alarm conductor such as an electrical conductor or a fiber optic conductor extending about the perimeter of the housing and/or about the internal audible alarm speaker, which if severed by a thief attempting to cut through the housing and/or speaker, will actuate the alarm, preventing disabling the security device in such a manner.

Still another aspect of the invention is to provide such a security device in which the cable can be attached by a plug insertable into the security device housing and secured by a magnetically attractable locking mechanism, or which includes a plurality of cables which are placed about an object and tightened thereabout by use of a ratchet mechanism contained within the security device.

A further aspect of the invention is to provide the perimeter security and alarm feature by use of a single electrical conductor or fiber optic rod or cable which can be located in one of the side walls of the security device housing or placed about the audible alarm speaker, and connected to the appropriate circuitry or internal circuit board which provides the alarm system for the security device.

Another feature of the present invention is to provide the housing of the security device with a simulated speaker grille having a plurality of through holes or recessed openings to indicate to a potential thief that an alarm is present in the security device wherein the actual audio speaker is located at a distance remote from the simulated speaker grille, and in which an audible alarm conductor loop extends about the simulated speaker grille within the housing in order to sound an alarm when severed by a potential thief who is mislead by the simulated speaker grille without any danger to the actual audio speaker located in the housing remote from the simulated speaker grille.

Another aspect is to form the simulated speaker grille in a product upside of the housing of the security device with the true audible speaker being located in the housing remote from the simulated speaker grille and facing a product downside of the housing to further protect the security device from unauthorized tampering.

These features are obtained by the security device of the present invention, the general nature of which may be stated as a device adapted to be secured to an object comprising a housing, a cable loop extending from the housing for attachment to the object; an alarm system contained in the housing, the alarm system including an audible alarm; a first alarm conductor operationally connected to the alarm system and extending in a continuous loop configuration within the housing and about a portion of the housing and when severed will actuate the audible alarm; a simulated speaker grille formed in the housing; and a second alarm conductor extending closely adjacent the simulated speaker grille within the housing which when severed will also actuate the audible alarm.

BRIEF DESCRIPTION OF THE SEVERAL VIEWS OF THE DRAWINGS

Preferred embodiments of the invention, illustrative of the best modes in which Applicant contemplates applying the principles, are set forth in the following description and are shown in the drawings and are particularly and distinctly pointed out and set forth in the appended claims.

Similar numbers refer to similar parts throughout the specification.

DETAILED DESCRIPTION OF THE INVENTION

Figure 1:
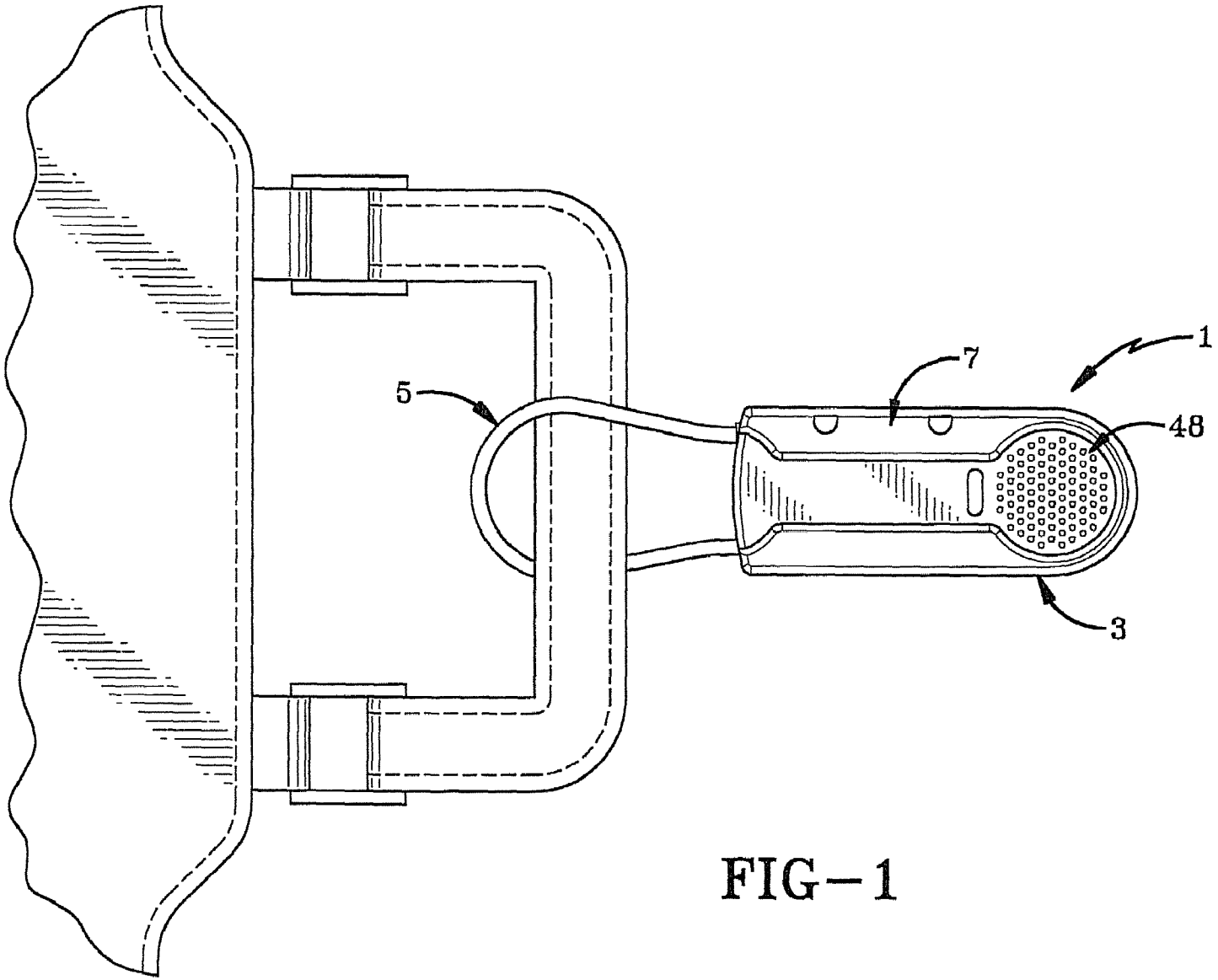
FIG. 1 is a diagrammatic illustration showing one type of security device of the present invention which is attached by a cable to an article to be protected thereby.

A first embodiment of the improved security device of the present invention is shown in FIGS. 1-4, and is indicated generally at 1, and is referred to broadly as a cable alarm device. Device 1 is very similar to the device shown in pending patent application Ser. No. 11/315,052, published Aug. 3, 2006 as Publication No. 2006/0170550, the contents of which are incorporated herein by reference. Device 1 includes a housing 3 and a locking cable 5. Housing 3 includes two generally half body components 7 and 8, preferably formed of a rigid plastic material and secured together by an adhesive, sonic weld or the like. Device 1 has an internal compartment 9 in which is mounted an alarm system indicated generally at 11 (FIGS. 2 and 3), and a lock mechanism indicated generally at 13.

Housing 3 has a relatively elongated flat configuration wherein the thickness is considerable less than its length. This provides a relatively compact, yet pleasingly attractive device. Lower half body portion 8 (FIGS. 2 and 3) includes an outer peripheral wall indicated generally at 15, having straight side segments 14, a curved top section 16 and a lower end section 17. The two half body members may have positioning posts 21 which extend into bosses formed on the opposite housing member to properly align the members together before final joinder thereof.

Figure 2:
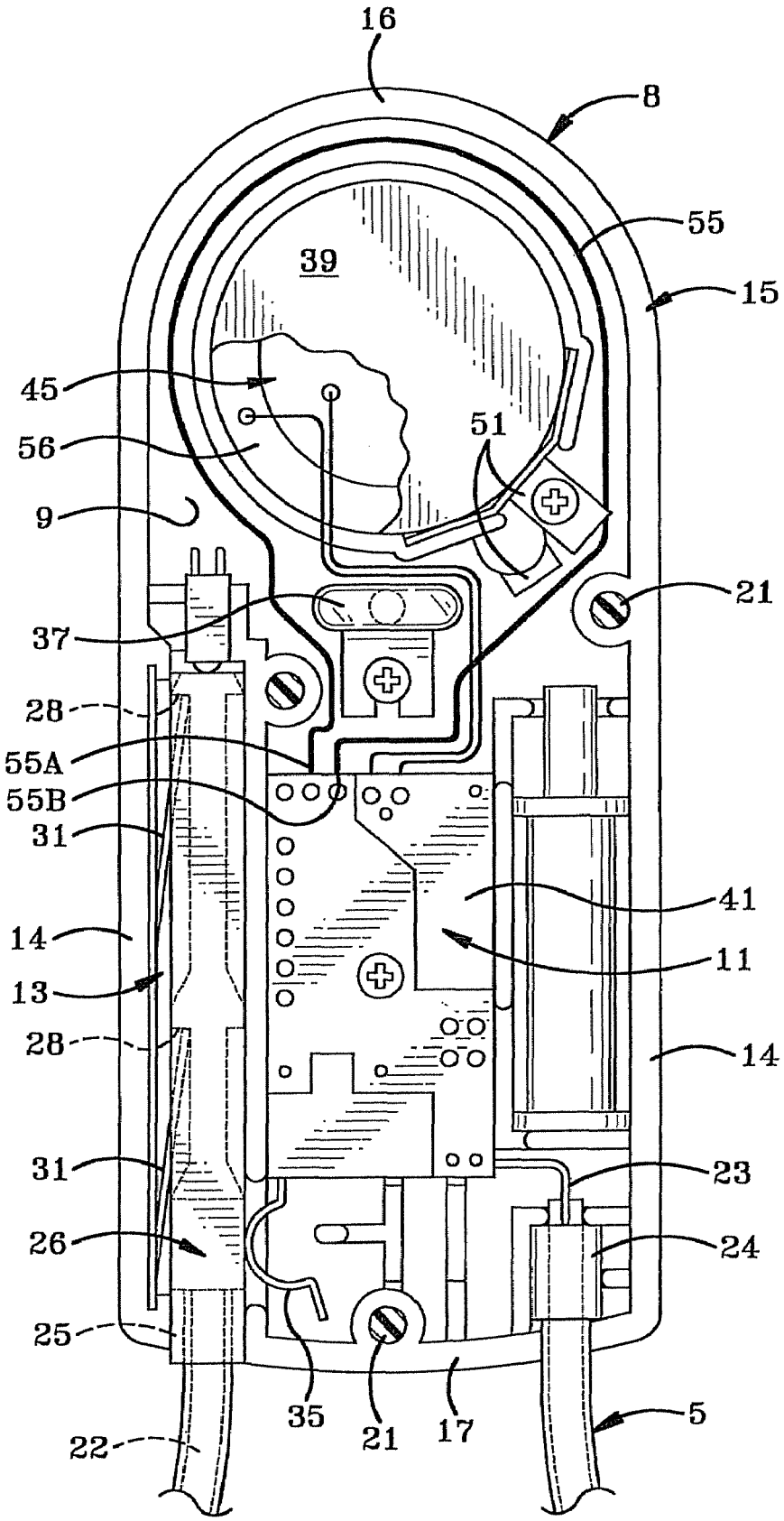
FIG. 2 is an enlarged plan view of the security device of FIG. 1 with a one half portion of the housing removed therefrom, and with the conductor alarm extending about the audible alarm speaker.
Figure 3:
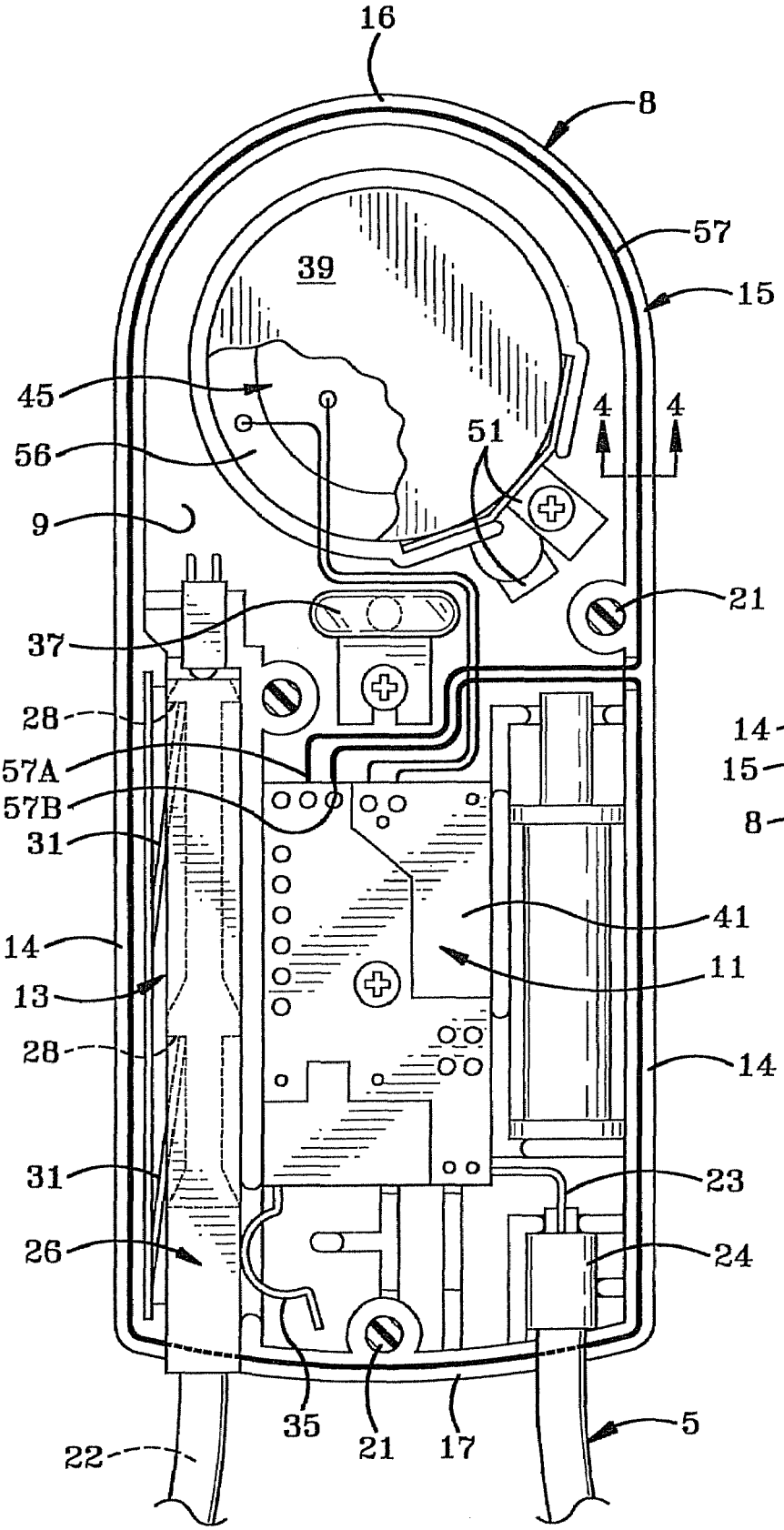
FIG. 3 is a view similar to FIG. 2 showing another embodiment in which the conductor alarm extends around the periphery of the housing of the security device.

Locking cable 5 includes an internal conductive cable 22 covered by a dielectric insulation with a first end being connected to an electrical connector 24 and the second end being connected to an electrical connector 25, which connector forms an end of a locking plug 26. Locking plug 26 preferably is formed of a dielectrical material and has a pair of locking shoulders 28 formed thereon, which when in the locked position, engage a pair of spring biased metal tines 31. Tines 31 are magnetically attractable by a magnet when placed proximate thereto to remove them from their locking engagement with shoulders 28 to enable locking plug 26 to be removed from its locked position within housing 3. As shown in FIGS. 2 and 3, connector 24 is connected to alarm system 11 by a conductor 23, and connector 25 is electrically connected to the alarm system by a spring metal clip 35. An LED 37 may be mounted within compartment 9 and electrically connected to a battery 39 through a printed circuit board 41 which forms the basis of alarm system 11, which alarm system and circuitry thereof will be of a usual construction well-known to those skilled in the alarm security art.

An audible alarm 45, and in particular speaker 56 thereof, is located within a circular boss formed in housing 3 adjacent a perforated area 48 which forms a grille-like structure in housing body half member 7 through which an alarm sound is emitted. Battery 39 supplies the electrical power for the alarm system 11 through terminals 51. The other components of security device 1 and alarm system 11 and their manner of operation are the same as that described in the above-referenced provisional application Ser. No. 11/315,052.

In accordance with the invention, alarm conductor 55 is mounted on the inside surface of one of the half body members, preferably half body member 8, and extends in a loop-like manner partially about audible alarm speaker 56. First and second ends 55A and 55B of conductor 55 are connected to printed circuit board 41 of alarm system 11 as shown in FIG. 2. Conductor 55 in the preferred embodiment is an electrical conductor and is a relatively thin wire of solid or braided metal such as copper, covered by a dielectric material and will be electrically energized when the security device is activated. However, conductor 55 can be a fiber optic rod or cable, a light pipe, etc. without affecting the concept of the present invention. Thus, should conductor 55 be severed or pulled loose from circuit board 41, it will actuate the audible alarm. This prevents a thief from using a pair of snips or the like to disarm the audible speaker since prior to cutting through alarm speaker 56 it will sever conductor 55 actuating the alarm just prior to the speaker being disabled. Thus, when an alarm sound is emitted, even for a relatively very short period of time, it may be sufficient to alert store personnel that a theft is in progress and/or discourage the thief from continuing cutting through the housing.

Figure 4:
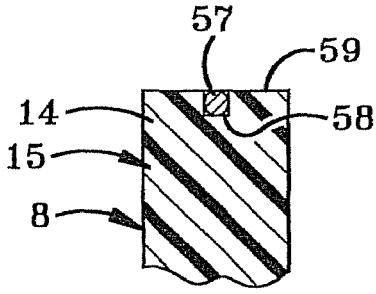
FIG. 4 is an enlarged fragmentary sectional view taken on line 4-4, FIG. 3.

A slightly modified version of the improved security device is shown in FIGS. 3 and 4, in which an alarm conductor 57 extends about the periphery of one of the housing members such as lower body member 8, where it is connected by ends 57A and 57B to the alarm system 11. Conductor 57 may be located within a shallow groove or recess 58 formed in a top surface of perimeter wall 14 of body member 8. Conductor 57 also will be energized when security device is activated and will sound the audible alarm immediately upon being severed by someone attempting to cut through housing 3 with a pair of snips or other type of severing device.

Thus, conductors 55 and 57 provide for a very simple additional security measure which can be mounted within a type of cable alarm security device as shown in FIGS. 1-4, by placing the alarm conductor in a general loop fashion about the perimeter of the audible alarm speaker and/or about the external periphery of the housing of the security device. This requires only the use of a thin electrical conductor, fiber optic rod or cable, light pipe, etc. and its attachment to the appropriate circuitry of alarm system 11.

A second embodiment of the improved security device is indicated generally at 65, and is shown in FIGS. 6-9. Security device 65 is very similar to the device disclosed in U.S. Pat. No. 7,162,899, the contents of which are incorporated herein by reference. This type of device is referred to a cable wrap security device in that it includes a plurality of cables 67 which extend outwardly from a housing 68. The cables wrap around an object such as a box 70, where they are tightly secured by a ratchet mechanism contained within housing 68, the details of which are clearly shown and described in said U.S. Pat. No. 7,162,899.

Housing 68 will include a flip-up handle 71 which is mounted on a dome-shaped top wall cover plate portion 72 of housing 68, which when in the raised operative position will enable the cables to be tightened about package 70. Top wall portion 72 is attached to a ratchet mechanism which includes a spool 73 so as to rotate therewith, and which is rotatably mounted on a disc-shaped base 74. Cable lock 65 will include an internal alarm system indicated generally at 75, and shown diagrammatically in FIG. 7. Alarm system 75 includes a plurality of electrical connectors 76 attached to each end of cables 67 which are electrically connected through a conductor 77 to a printed circuit board 80 which forms and contains the basic components of alarm system 75. A printed circuit board 80 is connected to a battery 81 which is mounted on spool 73. Battery 81 is connected to an audible alarm containing a speaker 83, which is located adjacent and behind a perforated grille 84 (FIG. 8), by conductors 85. The audible alarm emits a high pitched alarm signal should the integrity of any of the cables 67 be compromised or if an EAS tag (not shown) mounted in housing 68 pass in an unauthorized manner through a security gate.

Figure 7:
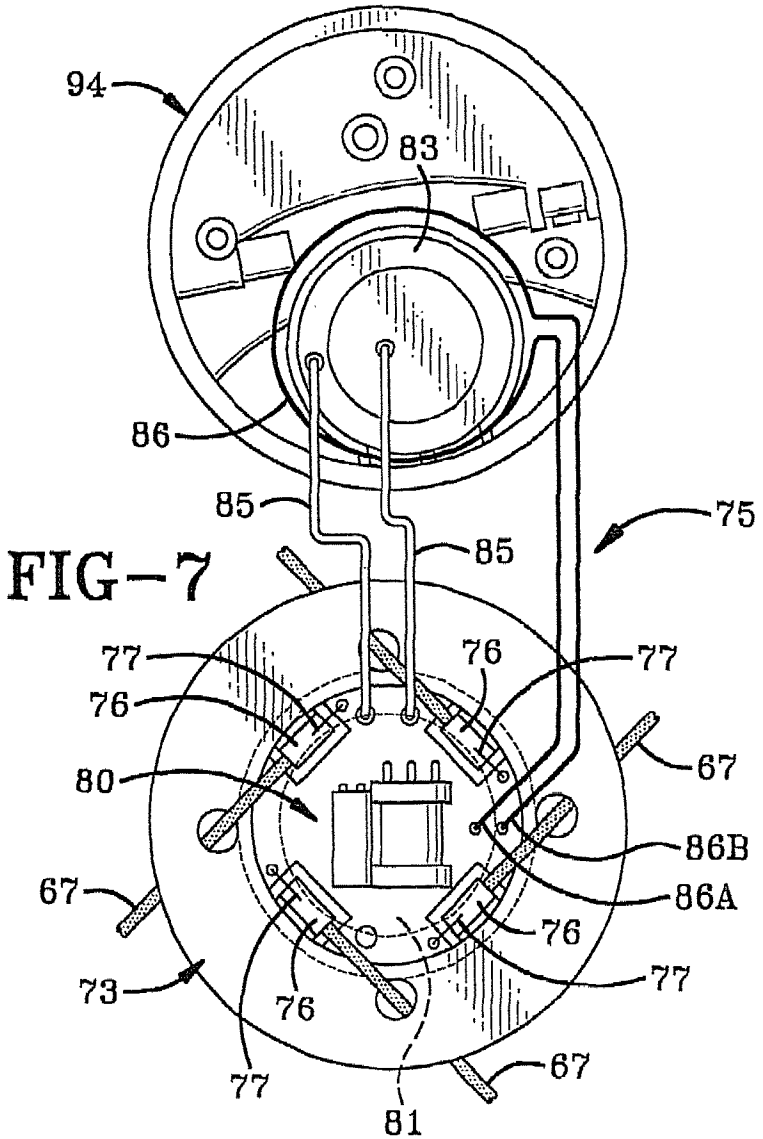
FIG. 7 is a partially exploded view of the top wall cover plate and alarm circuitry mounting plate of the security device of FIG. 6.

In accordance with the main feature of the present invention, an alarm conductor 86 extends in close proximity to and in a loop fashion about speaker 83 and is connected to printed circuit board 80 by end 86A and 86B (FIG. 7). Thus, if someone attempts to cut into housing 68 to damage speaker 83, it will first sever conductor 86 which will sound the alarm sufficiently in advance to being damaged to alert the store personnel.

In a slightly modified arrangement of embodiment 65 (FIGS. 8 and 9), an alarm conductor 90 is mounted in a recess 91 formed in the upper portion of a cylindrical side wall 92 of housing base 74. Dome-shaped top wall portion 72, in which grille-like portion 84 is formed and spool 73, are rotatably mounted on housing base 74 and secured thereto by a lock ring 95. Thus a thief attempting to cut through housing 68 in an attempt to disable the internal alarm or alarm speaker will initially sever conductor 90 which will actuate the audible alarm to alert the store personnel.

Figure 10:
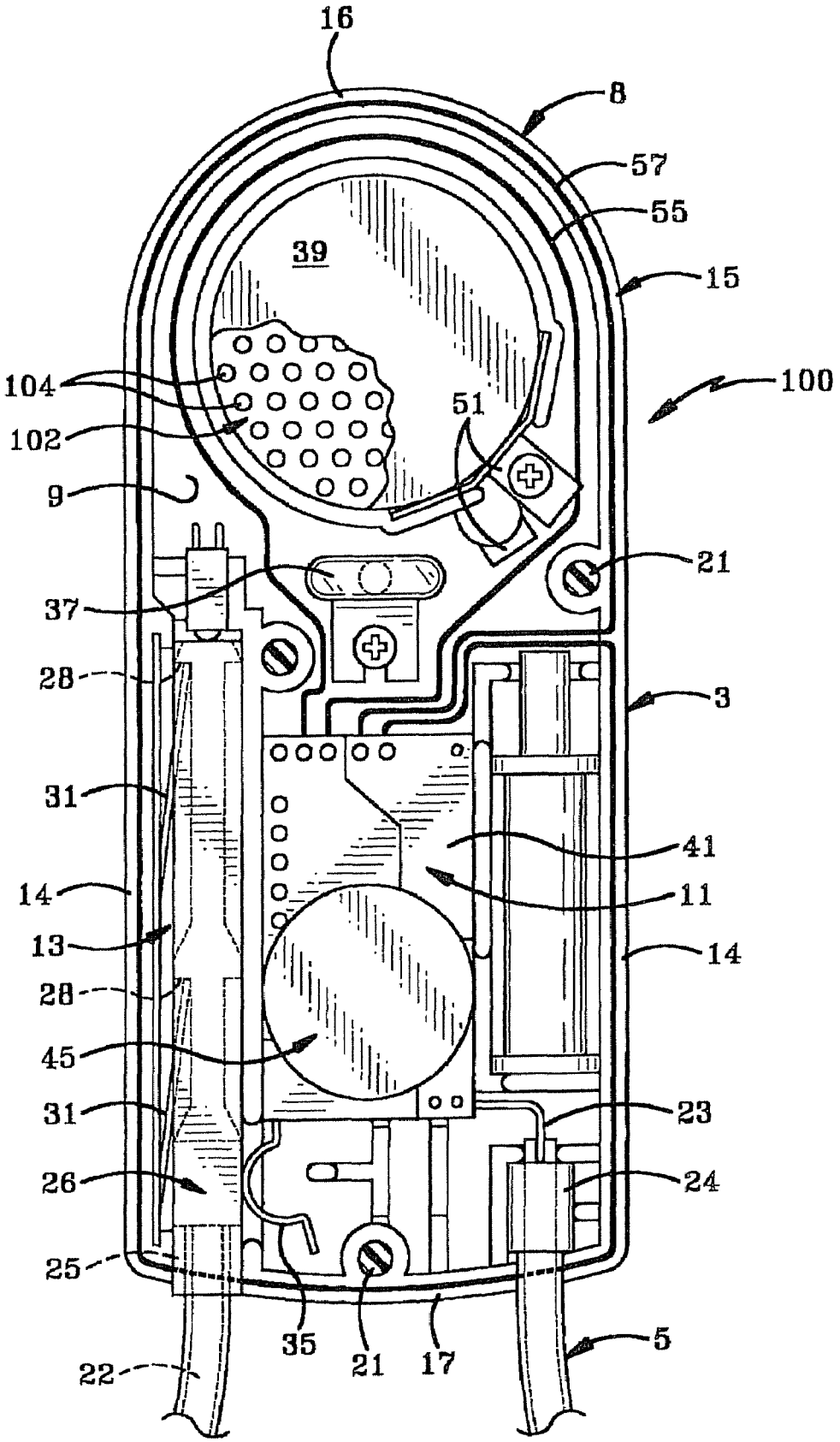
FIG. 10 is a diagrammatic plan view with portions broken away showing a modified security device with an alarm conductor extending about a simulated speaker grille.
Figure 12:
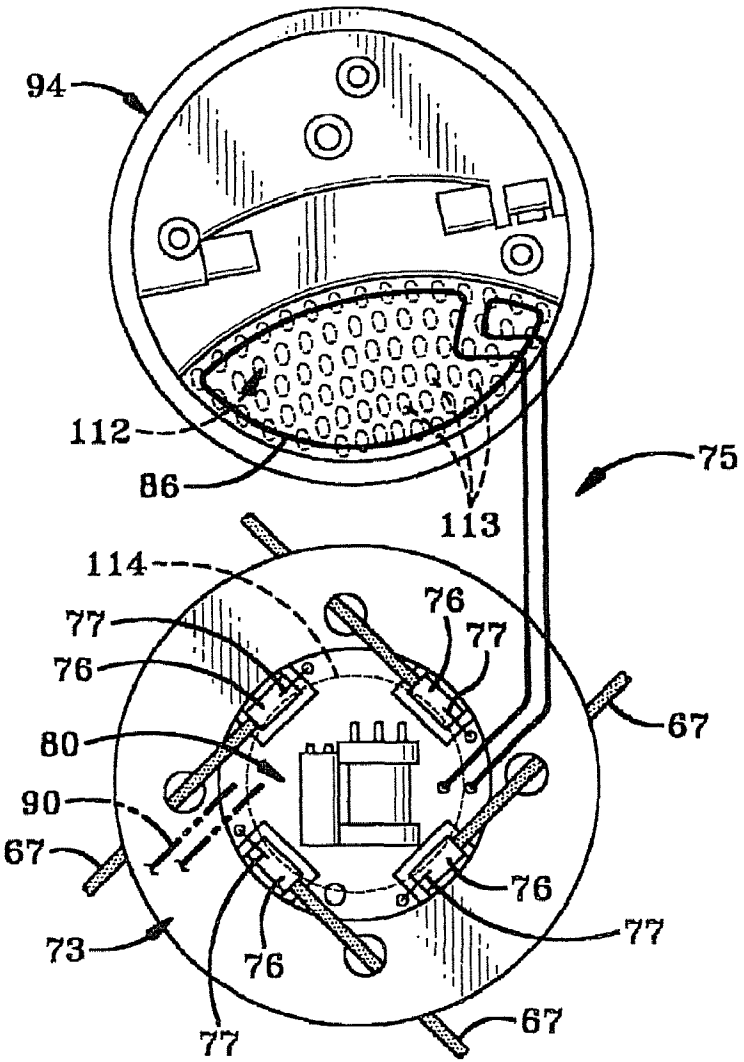
FIG. 12 is a partially exploded view similar to FIG. 7 of the top wall cover plate and alarm circuitry mounting plate of the security device of FIG. 11.
Figure 11:
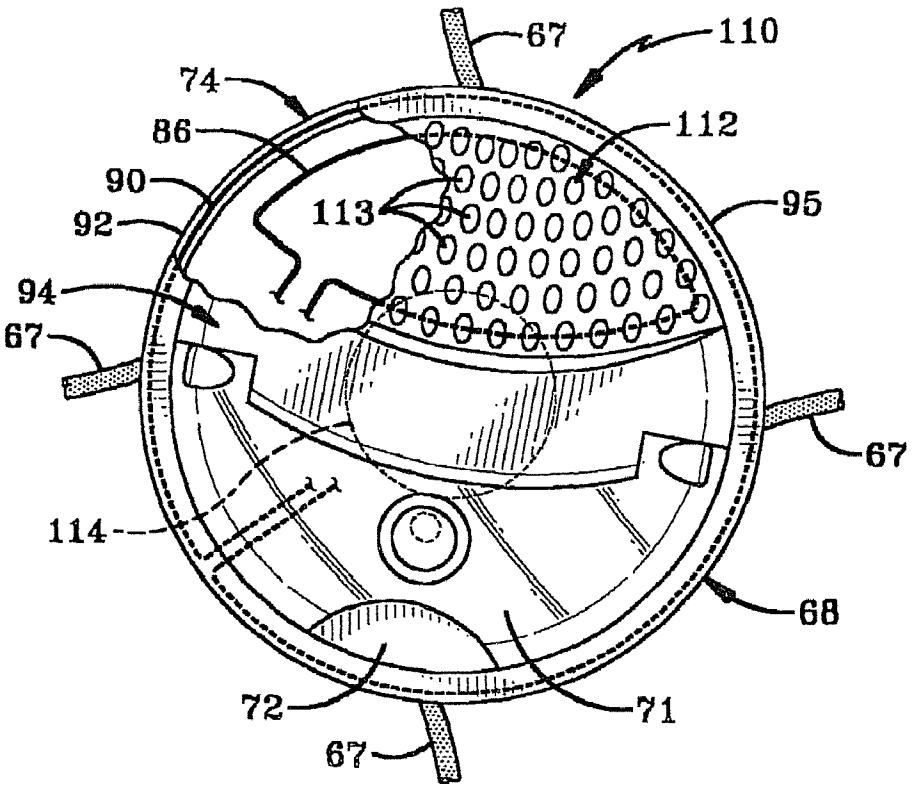
FIG. 11 is a diagrammatic top plan view with portions broken away showing a first alarm conductor extending about a simulated speaker grille and a second alarm conductor extending about portions of the sidewall in another type of security device.

Another embodiment of the security device of the present invention is shown in FIG. 10 and is indicated generally at 100, and is very similar to that in overall construction and method of operation to that shown in FIGS. 1-4. Thus, many of the components are similar and are numbered according to those discussed above with respect to security device 1.

The changes in security device 100 include a simulated speaker grille 102 which is formed in housing 3 which will be very similar in construction to that of perforated area 48 of security device 1. Conductor loop 55 will extend about simulated speaker grille 102 as around perforated area 48, and is connected to the alarm system 11, and in particular to the printed circuit board 41 thereof. The term "simulated speaker grille" means that a plurality of speaker holes 104 are formed in housing 3 and extend completely through into the interior of the housing or have the shape of circular recesses simulating speaker holes and do not extend completely through the housing without an actual audible alarm speaker being located adjacent the holes or recesses. This arrangement of through holes or circular recesses or similar actual or simulated openings provide an indication to the observer that it is a speaker grille located adjacent an alarm speaker. This initially will deter many would-be thieves since it indicates that the security device is protected by an audible alarm.

In accordance with another feature of security device 100, the actual audible alarm 45 is located remotely from simulated speaker grill 102 as shown in FIG. 10, and is completely inaccessible to a would-be thief who believing the audible speaker is located adjacent the speaker grille 102 will cut through the housing to inactivate the alarm speaker. However severing either conductor loop 55 or 57 will cause alarm 45 to sound alerting store personnel. Thus, the use of a simulated speaker grille and a remotely located actual audible alarm speaker in combination with one or more electrical conductors 55 and 57, will provide additional security for security device 100 than that provided in the embodiment of FIG. 1.

Another embodiment of the security device is indicated generally at 110, and is shown in FIGS. 11-14. Device 110 is similar in construction and operation to that of security device 65 shown in FIGS. 5-9. Again, the difference of security device 110 to that of security device 65 is the providing of a simulated speaker grille 112 having the actual through holes or simulated holes 113 such as circular recesses, formed in the top wall cover plate 72 of housing 68. The actual audible alarm 114 is mounted on spool 73 and spaced from the simulated speaker grille 112 and is connected to the printed circuit board of the alarm system so that upon severing of conductor loop 90 which encircles the outer housing or conductor loop 86 which is located closely adjacent the simulated speaker grille, will cause audible alarm 114 to sound.

Figure 5:
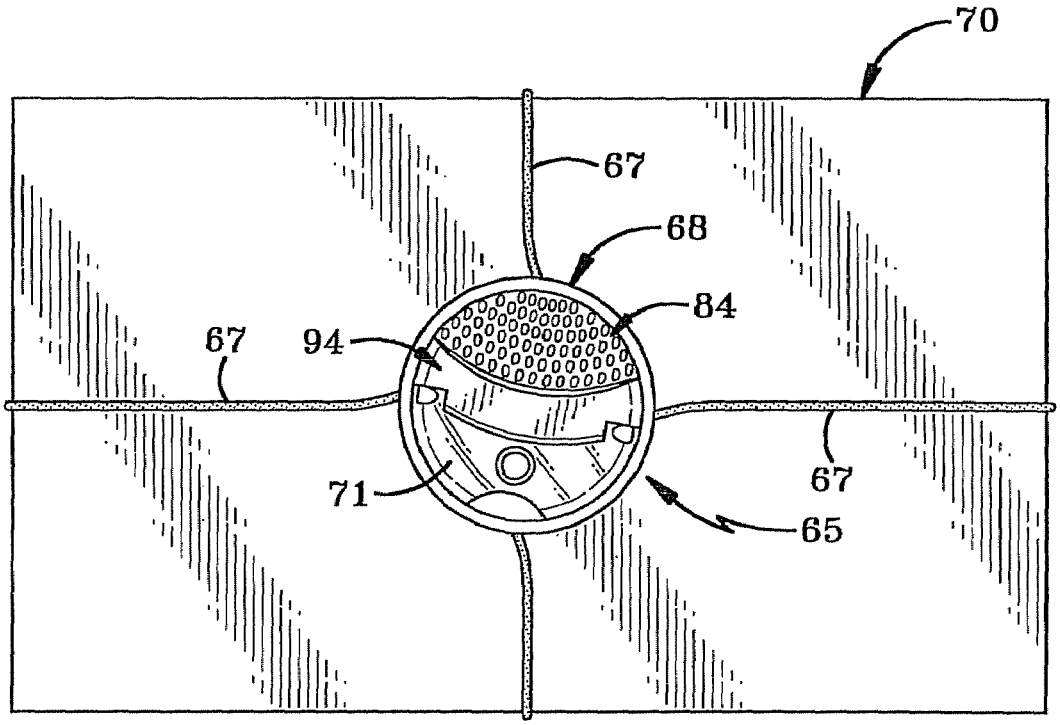
FIG. 5 is a diagrammatic illustration of another type of security device of the present invention which is mounted on a package.
Figure 6:
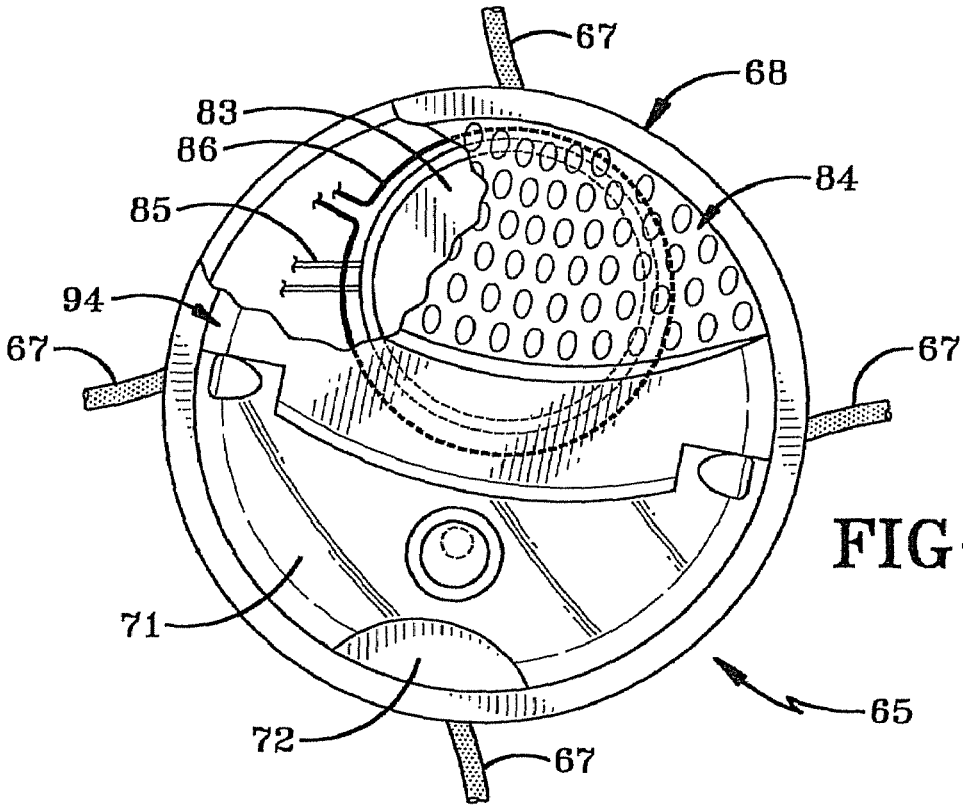
FIG. 6 is an enlarged view of the security device of FIG. 5 with portions broken away showing the conductor alarm extending about the audible alarm speaker.
Figure 8:
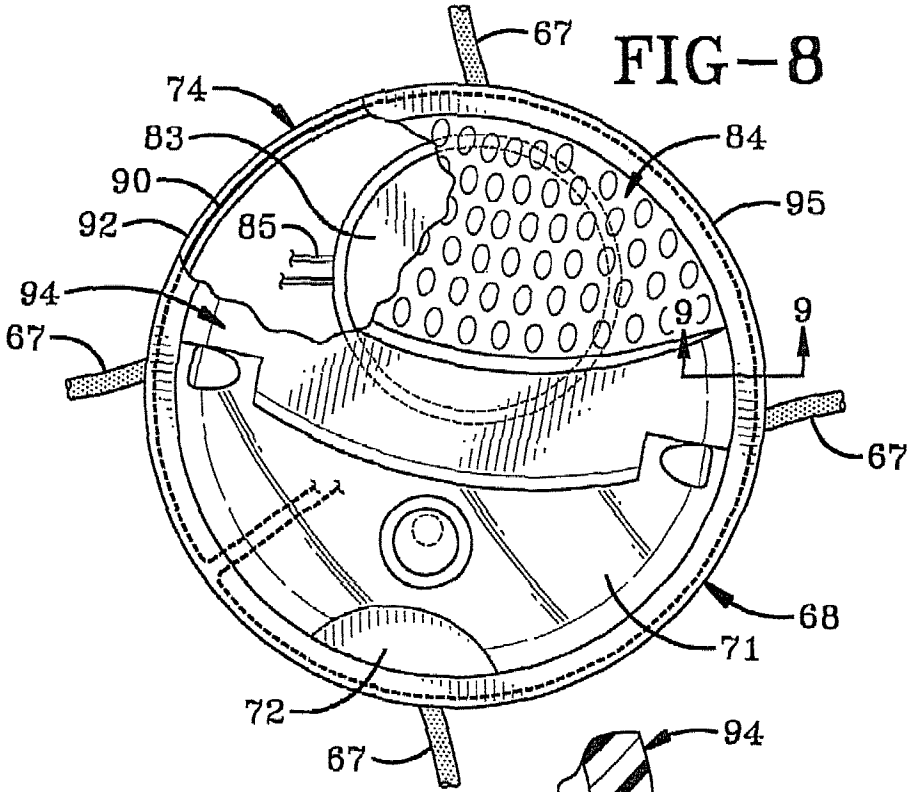
FIG. 8 is a top plan view with portions broken away, of the security device of FIG. 5, with the conductor alarm extending about the outer periphery of the housing of the security device.
Figure 9:
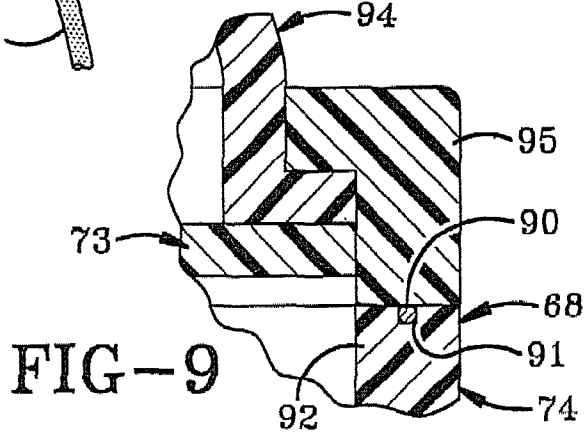
FIG. 9 is an enlarged fragmentary sectional view taken on line 9-9, FIG. 8.
Figure 13:
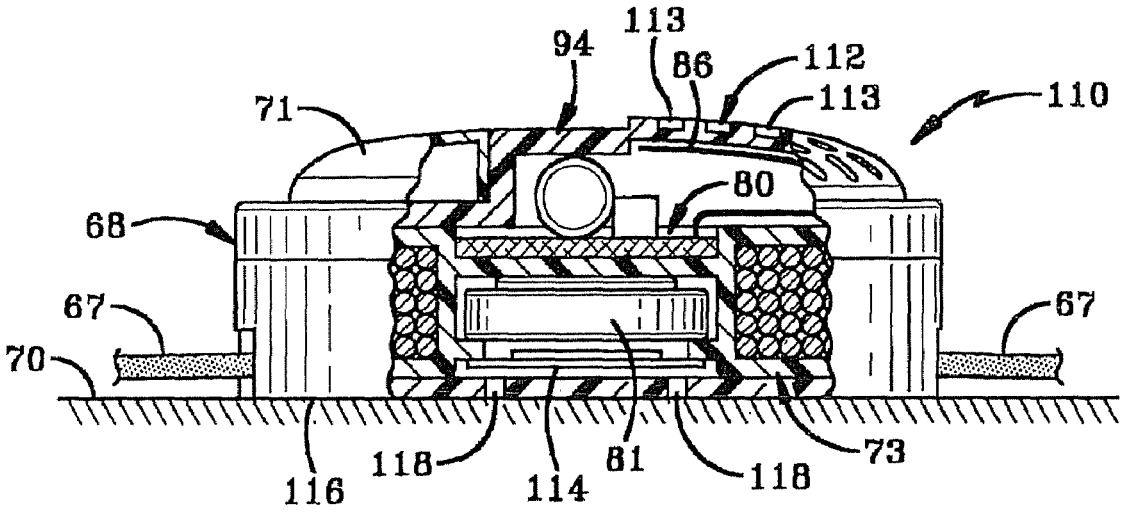
FIG. 13 is a side elevational view with portions broken away of the security device of FIG. 11.
Figure 14:
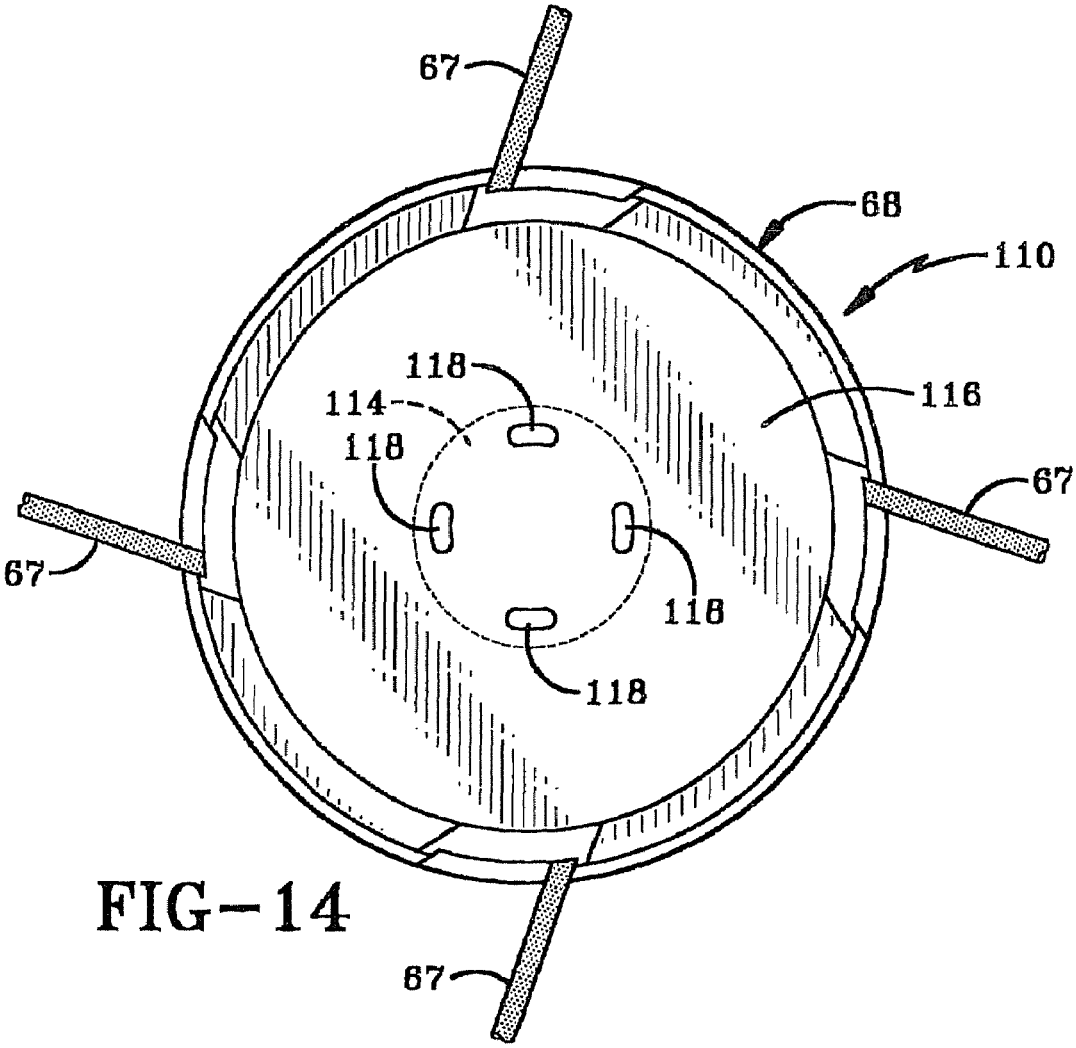
FIG. 14 is a bottom plan view of the security device of FIG. 11.
Figure 15:
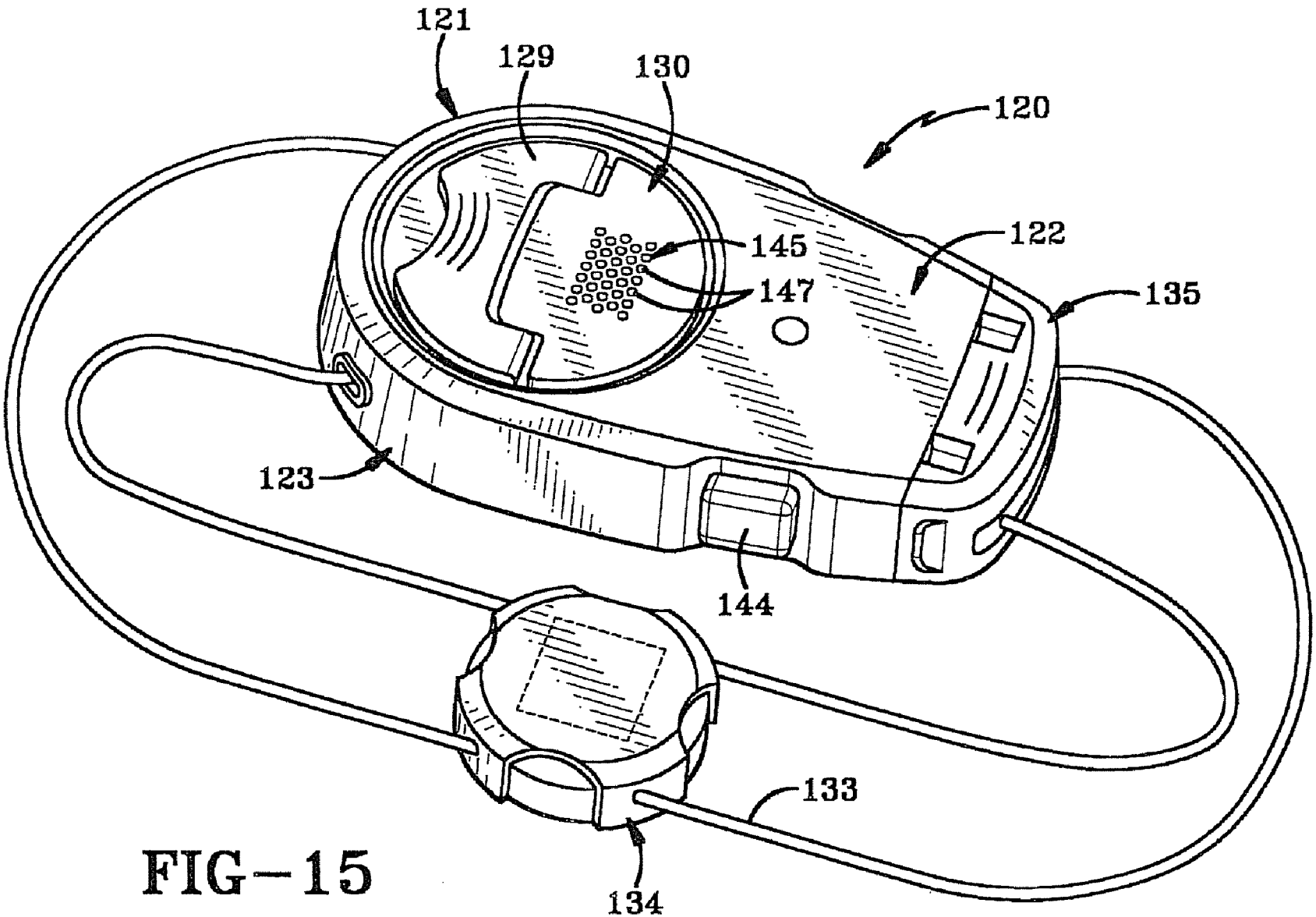
FIG. 15 is a top perspective diagrammatic view of another type of security device having an alarm conductor extending about a simulated speaker grille.

In accordance with another feature of modified security device 110, the device will have a product upside as shown in FIG. 13 and a product downside which actually is the bottom surface 116 of housing 68 when placed on an object protected thereby such as package 70 shown in FIG. 5. In this configuration, the actual or true audible alarm 114 will face towards the product downside where the sound will be emitted through a plurality of openings 118 as shown in FIGS. 13 and 14, with the simulated speaker grille being located on the product upside and readily visible to a would-be thief. Thus, again, security device 110 will deter a potential thief by providing a visual indication by simulated speaker grille 112, that the device is protected by an audible alarm wherein the true alarm 114 is located remote from the simulated speaker grille, and not readily inaccessible by a would-be thief.

Furthermore, device 110 will sound audible alarm 114 upon a thief severing either of the electrical conductors 86 or 90 in an attempt to disarm the alarm which the thief believes is located closely adjacent simulated speaker grille 112. Also, the sound will still be emitted from the housing through the actual speaker opening 118 as shown in FIGS. 13 and 14 A still further embodiment of the security device is indicated generally at 120, and is shown in FIGS. 15-18. Security device 120 is similar to the security device set forth in pending patent application Ser. No. 12/027,296, filed Feb. 7, 2008, the contents of which are incorporated herein by reference. Security device 120 includes a main housing 121 comprised of an upper housing member 122 and a bottom housing member 123 which can be jointed together by adhesives, sonic welding etc. to form an internal spool compartment 124 in which is rotatably mounted a cable spool 125, and a rear lock compartment 126. Upper housing member 122 has an elongated configuration with a main circular opening 128 in which is rotatably mounted a winder mechanism 130. Winder mechanism 130 is operationally connected to cable spool 125 and includes a flip-up handle 129 which is pivotally mounted by a pair of pivot pins 131 on the main disc-shaped body portion of the winder mechanism. Winder mechanism 130 is secured to cable spool 125 by projections or other types of connections so as to be rotatable therewith.

A cable 133 which could be a single loop or a pair of cables, is connected to spool 125 with the other cable ends being connected to an attachment clip 135, and preferably includes a cross over pod 134. Cable 133 is stored on spool 125 which is rotatably mounted within spool compartment 124 on a post 139 extending upwardly from a circular plate 137 which is mounted in a circular hole formed in bottom housing member 123. Post 139 is connected to a coil spring 143 which provides the biasing force on spool 125 to rotate the spool in the winding direction to retract the cable onto the spool into a stored position. Spool 125 has spaced flanges and an intervening wall which form a cable storage area therebetween. Winder mechanism 130 is fixed to spool 125 and is manually rotated by the use of flip-up handle 129 for rotating spool 125 in a clockwise direction to tighten cable 133 about a product after retracting the cable into housing 121 by the biasing force of spring 143.

A ratchet mechanism engages spool teeth to prevent movement of the spool in the unwinding direction as in similar types of spool ratchet mechanisms. A release button 144 is pivotally mounted in spool compartment 124 to provide for the take-up of cable 133. Attachment clip 135 is slidably inserted into the lock compartment 126 at one end of housing 121 to secure cables 133 in a locked position about the object. It is released by a key, such as a magnetic key as shown and described in the above-identified patent application Ser. No. 11/023,721.

Figure 16:
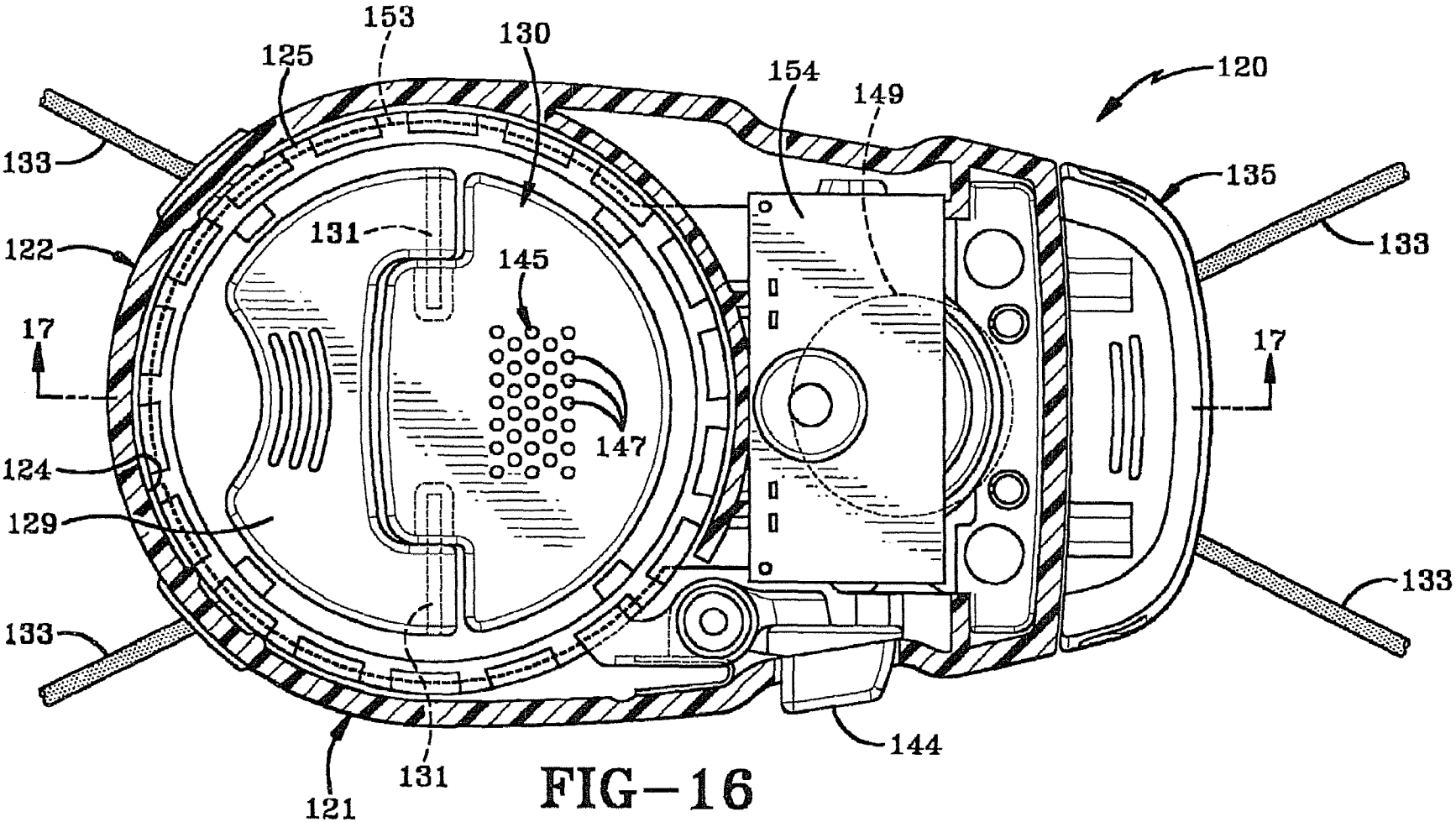
FIG. 16 is an enlarged top plan view with portions in section showing the alarm conductor extending about the simulated grille in the security device of FIG. 15.
Figure 17:
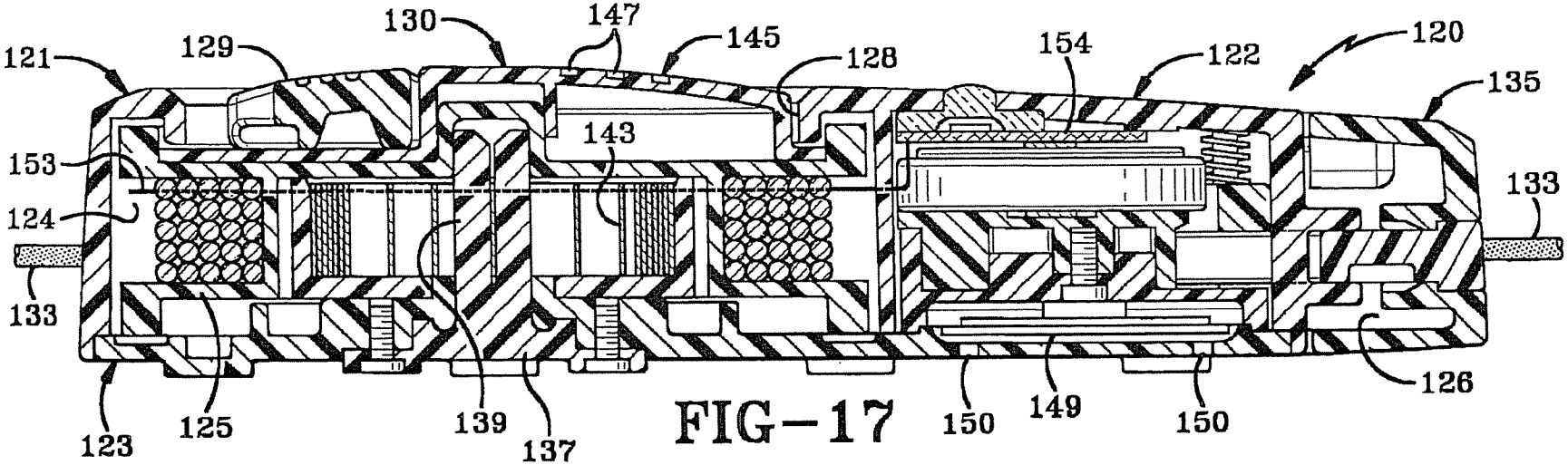
FIG. 17 is an enlarged sectional view taken on line 17-17 (FIG. 16).
Figure 18:
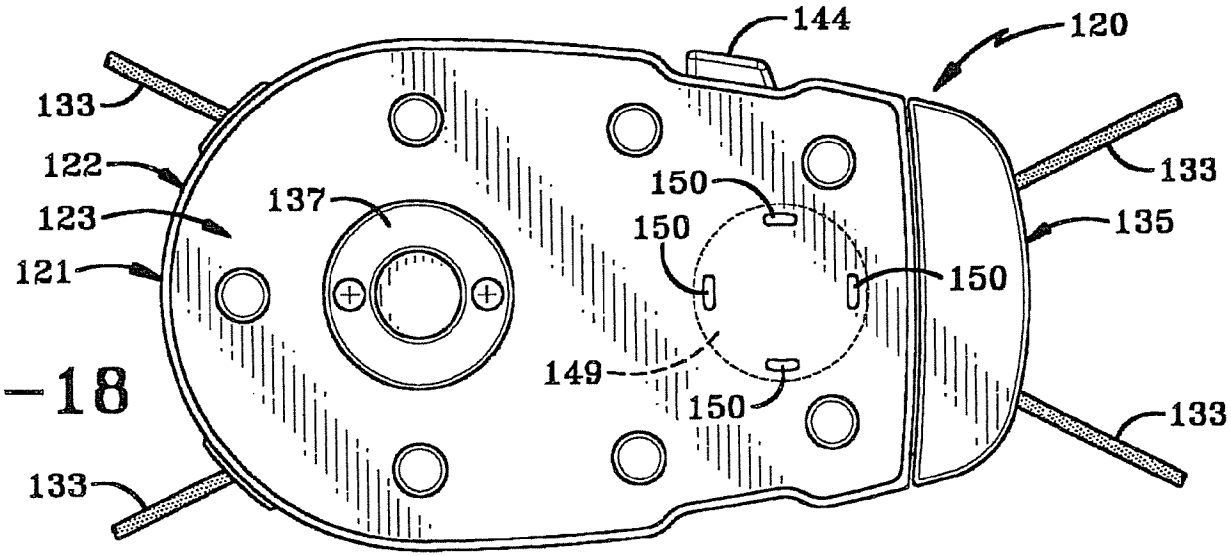
FIG. 18 is a bottom plan view of the security device shown in FIG. 15.

Again, in accordance with one of the main features of the invention, a simulated speaker grille 145 is formed in the winder mechanism 130 and has a plurality of actual or simulated perforations or holes 147. Furthermore, the true or actual audible alarm and speaker 149 is located remote from the simulated speaker grille 145 and audibly communicates with a plurality of holes 150 formed in the bottom wall 123 of housing 121. Bottom wall 123 is the product downside when security device 120 is mounted on a protected object. This again protects the audible alarm from being attacked by a potential thief, since the thief will believe that the audible alarm is located beneath the simulated speaker grille 145. Furthermore, as shown in FIG. 16, an electrical conductor 153 extends about simulated speaker grille 145 in a looped configuration and is connected to a printed circuit board 154 on which is formed the alarm circuitry for sounding audible alarm 149 upon a would-be thief severing conductor loop 153.

Figure 19:
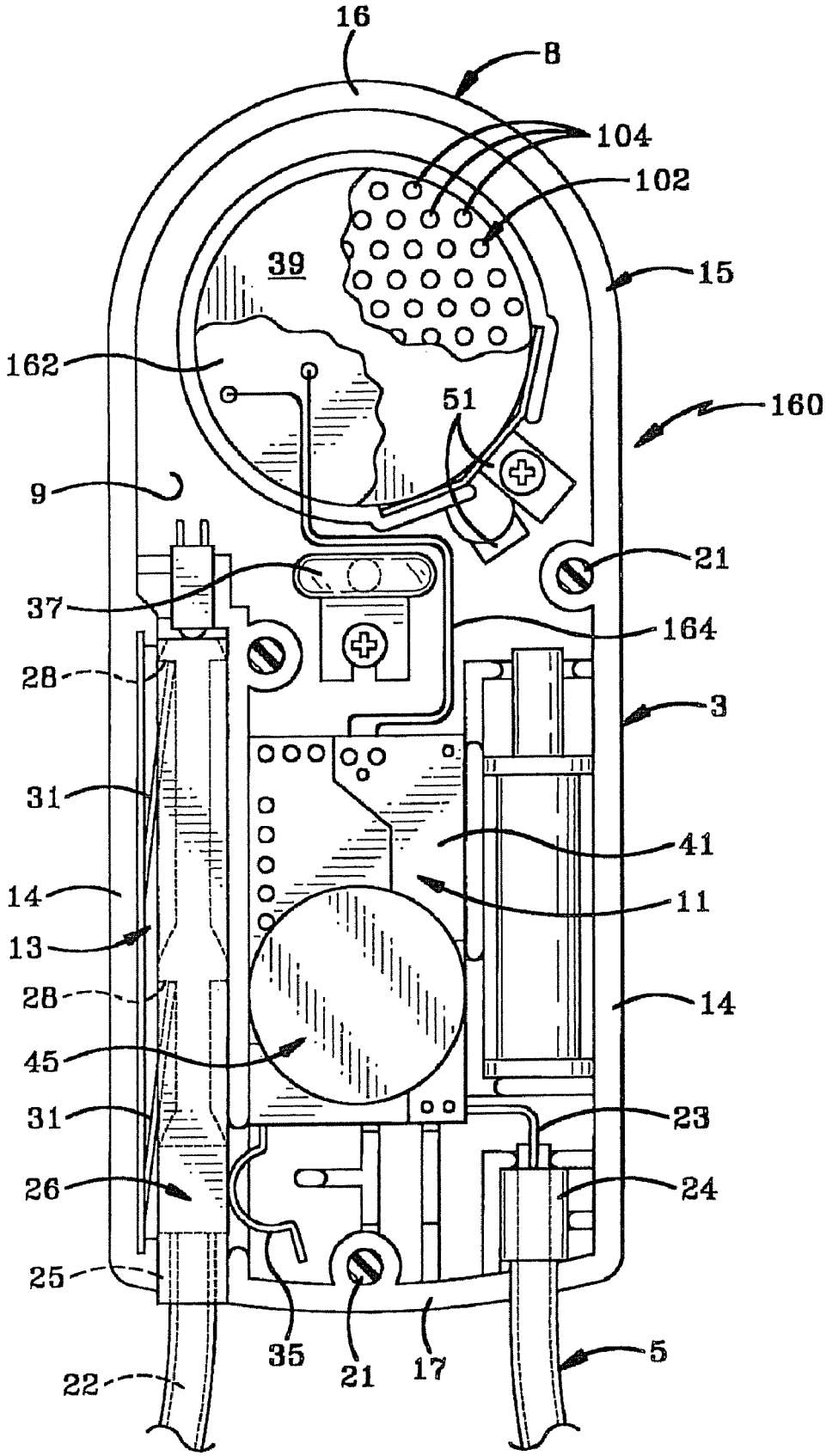
FIG. 19 is a plan view with portions broken away showing a security device similar to that shown in FIGS. 2 and 10 with another type of alarm conductor in the form of a disc located adjacent a simulated speaker grille.

Still another embodiment of the present invention is indicated generally at 160, and is shown in FIG. 19. Embodiment 160 is very similar to embodiment 1 and 100 discussed above, with the main difference being that the circular looped conductor 55 is replaced with a metallic disc or film 162 which is generally complementary in shape with simulated speaker grille 102 and is connected to the alarm circuitry by a pair of conductors 164. A would-be thief upon entering a sharp object or severing the simulated speaker grille 102 will contact metallic disc 162 either grounding or completing an electrical circuit actuating audible alarm 45 in a similar manner as discussed above with respect to the severing of the electrical conductors.

In summary, the security device of the present invention enables a simple conductor to be mounted either about the periphery of the housing or other structural components which form the security device, or around and in close proximity to an audible alarm speaker grille or a simulated speaker grille, so that when one or both of the alarm conductors are severed by a thief attempting to cut through the security device housing and/or speaker, it will immediately actuate the alarm system to emit a high pitched alarm signal. This additional feature is achieved by the relatively simple effective use of a single electrical conductor, fiber optic conductors, etc. arranged in a loop-like fashion or a metallic disc at a selected location within the housing of the security device and connected to the existing internal alarm circuitry which maintains the conductor energized when the alarm system is activated resulting in the sounding of the alarm if the integrity of the conductor is compromised, such as being severed or pulled away from its connection to the printed circuit board of the alarm system.

Furthermore, the use of a simulated speaker grille provides additional security to the security device by avoiding and preventing the actual audible speaker from being damaged upon a thief cutting through the housing or simulated speaker grille which will enable the alarm to continue sounding upon the protective electrical conductor or conductors being severed by the thief.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device adapted to be secured to an object, said device comprising:

a housing;

an attachment device on the housing for attaching the housing to the object;

an alarm system contained in the housing, said alarm system including an audible alarm to produce an audible sound responsive to a tampering condition of said attachment device;

a simulated speaker grille formed in the housing; and a conductor operationally connected to the alarm system and extending in a loop configuration about at least a portion of the simulated speaker grille and when severed will actuate the audible alarm to protect tampering of the alarm system.

2. The security device defined in claim 1 wherein the attachment device is at least one cable loop extending from the housing for attachment to the object.

3. The security device defined in claim 2 wherein a second alarm conductor extends about and closely adjacent a periphery of the housing and is connected to the alarm system and when severed will actuate the audible alarm to protect tampering of the housing.

4. The security device defined in claim 3 wherein the housing has an annular configuration with a base formed of a rigid plastic and a top wall cover plate; and in which a ratchet mechanism is located within the base and operationally connected to the cable loop for securing said cable loop about the object.

5. The security device defined in claim 1 wherein the housing has an annular configuration with a base formed of a rigid plastic and a top wall cover plate, said base including a speaker opening; and in which the audible alarm is located closely adjacent the speaker opening and spaced from the simulated speaker grille.

6. The security device defined in claim 5 wherein a portion of the conductor is mounted on and extends about an inside surface of the top wall cover plate.

7. The security device defined in claim 1 wherein the simulated speaker grille includes a plurality of holes extending through the housing and communicating with an interior of the housing.

8. The security device defined in claim 1 wherein the simulated speaker grille includes a plurality of circular recesses providing simulated speaker holes.

9. The security device defined in claim 1 wherein the housing has an object up side and an object down side; wherein the simulated speaker grille is located on the object up side; and wherein the audible alarm faces the object down side.

10. The security device defined in claim 1 wherein the alarm system includes a printed circuit board mounted within the housing; and in which the conductor is an electrical conductor having first and second ends electrically connected to the circuit board.

11. The security device defined in claim 1 wherein the conductor is an electrical conductor; and wherein a battery is located in the housing to provide electric power to the alarm system and electrical conductor loop.

12. The security device defined in claim 11 wherein the conductor is a fiber optic conductor.

13. The security device defined in claim 1 wherein the cable loop has a first end connected to the housing and a second end connected to a plug, said plug being selectively connectable to and removable from the housing; and in which the alarm system is operatively connected to the cable loop to sound an audible alarm contained within the housing when the integrity of the cable is compromised.

14. The security device defined in claim 13 wherein a locking mechanism is mounted within the housing and engageable with the plug to lock the plug to the housing.

15. A security device adapted to be secured to an object, said device comprising:

a housing;

an attachment device on the housing for attaching the housing to the object;

an alarm system contained in the housing, said alarm system including an audible alarm to produce an audible sound responsive to a tampering condition of said attachment device;

a simulated speaker grille formed in the housing and located remote from the audible alarm; and a conductor operationally connected to the alarm system and located closely adjacent the simulated speaker grille and when contacted by an object inserted through the speaker grille will actuate the audible alarm so as to protect tampering of the alarm system.

16. The security device defined in claim 15 wherein the conductor is a metallic disc.

17. The security device defined in claim 16 wherein the metallic disc is generally complementary in diameter to the diameter of the simulated speaker grille and is located immediately adjacent said speaker grille.

18. A security device adapted to be secured to an object, said device comprising:

a housing;

an attachment device on the housing for attaching the housing to the object;

an alarm system contained in the housing, said alarm system including an audible alarm to produce an audible sound responsive to a tampering condition of said attachment device;

a simulated speaker grille formed in the housing; and the audible alarm being located in the housing remotely from the simulated speaker grille;

wherein the device further including a first conductor operationally connected to the alarm system and extending in a loop configuration about at least a portion of the simulated speaker grille and when severed will actuate the audible alarm to protect tampering of the alarm system.

19. The security device defined in claim 18 wherein a second alarm conductor extends about and closely adjacent a periphery of the housing and is connected to the alarm system and when severed will actuate the audible alarm to protect tampering of the housing.

* * * * *